US010239662B2

(12) United States Patent
Park

(10) Patent No.: US 10,239,662 B2
(45) Date of Patent: Mar. 26, 2019

(54) HEIGHT-ADJUSTABLE CONTAINER

(71) Applicant: Hyun-Jin Park, Gyeonggi-do (KR)

(72) Inventor: Hyun-Jin Park, Gyeonggi-do (KR)

( * ) Notice: Subject to any disclaimer, the term of this patent is extended or adjusted under 35 U.S.C. 154(b) by 159 days.

(21) Appl. No.: 15/327,228

(22) PCT Filed: Jul. 23, 2015

(86) PCT No.: PCT/KR2015/007689

§ 371 (c)(1),
(2) Date: Jan. 18, 2017

(87) PCT Pub. No.: WO2016/013891

PCT Pub. Date: Jan. 28, 2016

(65) Prior Publication Data

US 2017/0152074 A1 Jun. 1, 2017

(30) Foreign Application Priority Data

Jul. 23, 2014 (KR) ..... 10-2014-0093557

(51) Int. Cl.

| | |
|---|---|
| ***B65D 21/02*** | (2006.01) |
| ***B65D 21/08*** | (2006.01) |
| ***B65D 43/02*** | (2006.01) |
| ***B65D 51/18*** | (2006.01) |
| ***B65D 45/20*** | (2006.01) |

(52) U.S. Cl.

CPC ..... *B65D 21/086* (2013.01); *B65D 21/0219* (2013.01); *B65D 43/02* (2013.01); *B65D 43/0212* (2013.01); *B65D 45/20* (2013.01); *B65D 51/18* (2013.01); *B65D 2251/009* (2013.01); *B65D 2251/0028* (2013.01); *B65D 2251/0081* (2013.01); *B65D 2543/005* (2013.01); *B65D 2543/00092* (2013.01); *B65D 2543/00296* (2013.01); *B65D 2543/00537* (2013.01); *B65D 2543/00555* (2013.01); *B65D 2543/00564* (2013.01); *B65D 2543/00574* (2013.01); *B65D 2543/00648* (2013.01); *B65D 2543/00685* (2013.01); *B65D 2543/00759* (2013.01); *B65D 2543/00805* (2013.01); *B65D 2543/00842* (2013.01); *B65D 2543/00972* (2013.01)

(58) Field of Classification Search

CPC ..... A47J 36/02; B65D 21/086
See application file for complete search history.

(56) References Cited

U.S. PATENT DOCUMENTS 5,605,242 A * 2/1997 Hwang ..... B65D 21/086 220/4.03

FOREIGN PATENT DOCUMENTS

| | | |
|---|---|---|
| JP | 2001163384 | 6/2001 |
| JP | 2013512753 | 4/2013 |
| KR | 2002840230000 | 7/2002 |

(Continued)

*Primary Examiner* — Stephen J Castellano
(74) *Attorney, Agent, or Firm* — IPLA P.A.; James E. Bame

(57) ABSTRACT

A height-adjustable container is configured such that an upper body and a lower body thereof are rotated from side to side in a zigzag form while coming into close contact with each other, so that the height of the container can be easily adjusted. The present invention enables the height of a container to be adjusted, whereby it is possible to make better use of a space of a refrigerator, a cabinet, or the like, in which the container is stored.

19 Claims, 17 Drawing Sheets

(56) References Cited

FOREIGN PATENT DOCUMENTS

| | | |
|---|---|---|
| KR | 1020100060137 | 6/2010 |
| KR | 2020120004477 | 6/2012 |
| KR | 1020120076227 | 7/2012 |

* cited by examiner

HEIGHT-ADJUSTABLE CONTAINER

This application is the national stage (Rule 371) of international application PCT/KR2015/007689 filed Jul. 23, 2015.

BACKGROUND

The present invention generally relates to a height-adjustable container. More particularly, the present invention relates to a height-adjustable container configured such that an upper body and a lower body thereof are rotated from side to side in a zigzag form while coming into close contact with each other, so that the height of the container can be easily adjusted.

In general, various foods, food ingredients, or the like is kept in a container that is provided in various shapes and sizes.

Here, containers of various sizes, in which various foods, food ingredients, or the like is kept, are required to be prepared according to the amount of contents, whereby a sufficient space may be required to store a plurality of empty containers.

Further, when the foods or food ingredients are consumed, it is required to move the contents to a small container to make better use of a space of a refrigerator, where containers are kept.

Meanwhile, "Space-adjustable container" is disclosed in the document of Korean Patent No. 10-1218258, which is configured such that an inner space of the container is adjusted according to the amount of contents. However, the container is problematic in that since the inner space thereof is adjustable while the appearance thereof is not, when the container is stored in a refrigerator or the like in a state where the container is not in use or a small amount of contents is kept in the container, space utilization is low.

SUMMARY OF THE INVENTION

Accordingly, the present invention has been made keeping in mind the above problems occurring in the related art, and the present invention is intended to propose a height-adjustable container configured to enable a height of a container to be adjusted, whereby it is possible to make better use of a space of a refrigerator, a cabinet, or the like, in which the container is stored.

The present invention is further intended to propose a height-adjustable container configured such that an entire height thereof is not dramatically changed undesirably when an external force is abruptly exerted onto the container in the process of adjusting a height of the container.

In order to achieve the above object, according to one aspect of the present invention, there is provided a height-adjustable container including: a first body including a height adjustment part that is provided with a plurality of guide grooves and a plurality of locking grooves, the guide grooves symmetrically and inclinedly arranged on an outside or an inside of the first body relative a vertical direction, the locking grooves integrally and circumferentially extending outward from corners of the guide grooves and being alternately arranged on opposite sides of the guide grooves; and a second body coupled to the outside or the inside of the first body, and provided with a guide protrusion guided along the guide grooves, wherein when a height between the first body and the second body is adjusted, the guide protrusion of the second body is alternately moved from side to side along the plurality of locking grooves.

Further, the guide protrusion of the second body may be guided by being moved from side to side along the guide grooves while coming into close contact with the guide grooves, and may be locked in one of the plurality of locking grooves that are alternately arranged at respective corners of the guide grooves to be symmetrical to each other, whereby the height between the first body and the second body is adjusted.

Further, the guide grooves may be arranged in a zigzag form, and are integrally connected to each other.

Further, the guide grooves and the locking grooves may be connected to each other at obtuse angles.

Further, a lowermost or an uppermost guide groove of the guide grooves may communicate with a vertical guide groove and extend to a lower end or an upper end of the first body.

Further, the height adjustment part may protrude from the first body to be in a raised shape, or may be grooved in the first body to be in a depressed shape.

The height-adjustable container may further include: a middle body provided between the first body and the second body, wherein the middle body is provided with a middle protrusion having a same shape as the guide protrusion, at a first side thereof facing the height adjustment part of the first body when the first body and the middle body are coupled to each other, such that the middle protrusion is guided along the height adjustment part, and the middle body is provided with a middle adjustment part having a same shape as the height adjustment part, at a second side thereof facing the guide protrusion when the second body and the middle body are coupled to each other, such that the guide protrusion is guided along the middle adjustment part.

The height-adjustable container may further include a packing for sealing a gap between the first body and the second body.

Further, when the second body is coupled to the outside of the first body, the packing may be mounted to the outside of the first body.

Further, when the second body is coupled to the inside of the first body, the packing may be mounted to an outside of the second body.

Further, the first body or the second body may be provided with a packing groove that receives the packing therein.

Further, when the second body is coupled to the outside of the first body, the packing groove may be provided in the outside of the first body, wherein the packing groove is disposed higher than an uppermost guide groove of the guide grooves and an uppermost locking groove of the locking grooves.

Further, when the second body is coupled to the inside of the first body, the packing groove may be disposed at an outside of a lower end of the second body.

The height-adjustable container may further include a container lid coupled to an end of the second body.

The height-adjustable container may further include: a plurality of coupling protrusions provided along an outer circumferential edge of the second body; and a plurality of coupling guide parts extending outside along an outer circumference of the container lid, and being movable toward the coupling protrusions, wherein each the coupling guide parts are provided with respective coupling guide holes, such that when the coupling guide parts are moved toward the coupling protrusions, the coupling protrusions are inserted into the respective coupling guide holes.

The height-adjustable container may further include: a lid packing provided between the container lid and the second body; and a seat groove provided in an inner circumferential surface of the container lid so as to receive the lid packing therein.

The height-adjustable container may further include: a through-hole provided in a top surface of the container lid; and an auxiliary lid for opening and closing the through-hole.

The height-adjustable container may further include a stopper provided in the locking groove by protruding to prevent the guide protrusion from moving when the guide protrusion is locked to the locking groove.

The height-adjustable container may further include: a lower connection part connecting lower portions of neighboring guide groove and locking groove to each other; and an upper connection part connecting upper portions of the neighboring guide groove and locking groove to each other, wherein the lower connection part and the upper connection part are disposed to avoid facing each other.

Further, the lower connection part may be disposed closer to the guide groove than the upper connection part is.

Further, the upper connection part may be disposed closer to the guide groove than the lower connection part is.

According to the present invention having the above-described characteristics, it is possible to make better use of space in a refrigerator, a cabinet, or the like, in which the container is kept.

Further, when a height of the container is adjusted, a first body and a second body are rotated from side to side in a zigzag form, whereby it is possible to adjust the height in multiple steps with minimal effort.

Further, when the height of the container is adjusted, the first body or the second body should be moved down by being rotated from side to side clockwise and counterclockwise alternately along guide grooves vertically inclined in a zigzag form, so the height of the container cannot be changed suddenly, whereby it is possible to prevent the height of the container from being changed undesirably when external pressure is abruptly exerted onto the container.

Further, when the height of the container is adjusted by exerting vertical pressure onto the first body or the second body, the guide protrusion is moved along the vertically inclined guide grooves, whereby frictional force is generated between the guide protrusion and the guide grooves, a part of the vertical pressure is offset by the frictional force, whereby it is possible to prevent the height of the container from being changed undesirably.

Further, a packing is provided between the first body and the second body, whereby it is possible to prevent contents inside the container form leaking outside when the height is adjusted.

Further, the packing is tightly fitted between the first body and the second body, whereby it is possible to prevent the first body or the second body from being undesirably rotated from side to side or from being suddenly moved down or up.

Further, an upper connection part and a lower connection part, which respectively connect upper portions and lower portions of the guide groove and locking groove, are formed to be asymmetrical to each other based on a vertical direction so as to have a unidirectional asymmetric structure, whereby in the case where contents are increased rather than reduced, it is possible to make it easier to move an upper body upward (height increase) than to move it downward (height decrease); and on the contrary, in the case where contents are reduced rather than increased, it is possible to make it easier to move the upper body downward (height decrease) than to move it upward (height increase).

Further, when a height between the first body and the second body is adjusted, it is difficult to adjust the height because the inside of the container is tightly sealed in the state where a container lid is not opened. However, since the present invention is provided with an auxiliary lid in the container lid, the container is unsealed by opening the auxiliary lid without opening the container lid, whereby it is possible to easily adjust the height of the container.

DETAILED DESCRIPTION OF THE INVENTION

Figure 1:
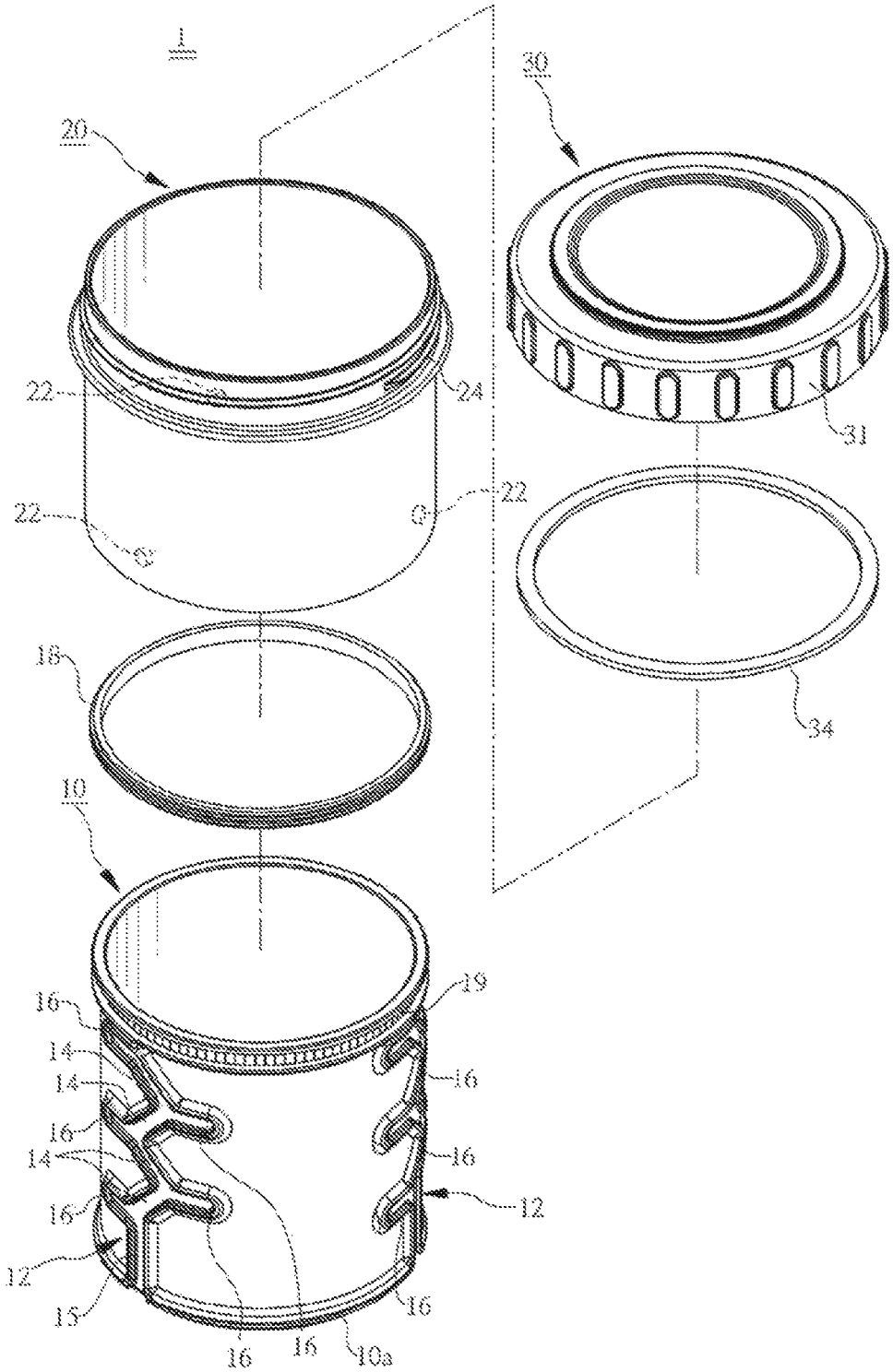
FIG. 1 is an exploded perspective view showing a height-adjustable container according to a first embodiment of the present invention.

Reference will now be made in greater detail to an exemplary embodiment of the present invention, an example of which is illustrated in the accompanying drawings. Wherever possible, the same reference numerals will be used throughout the drawings and the description to refer to the same or like parts.

Figure 2:
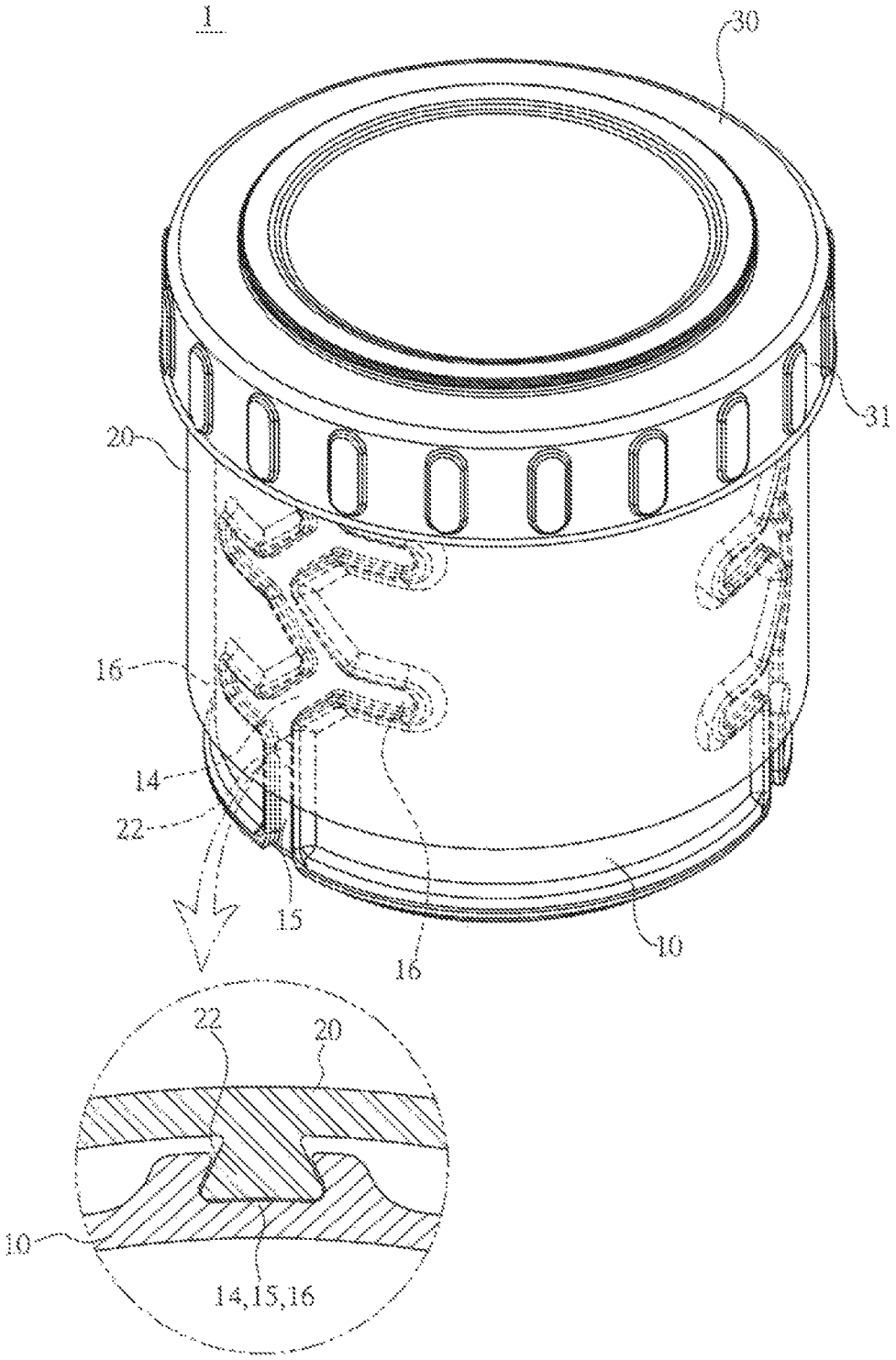
FIG. 2 is a combined perspective view showing the height-adjustable container according to the first embodiment of the present invention.

FIG. 1 is an exploded perspective view showing a height-adjustable container according to a first embodiment of the present invention; FIG. 2 is a combined perspective view showing the height-adjustable container according to the first embodiment of the present invention; and FIG. 3 is a combined sectional view showing the height-adjustable container according to the first embodiment of the present invention, which will be described all together for convenience.

Figure 3:
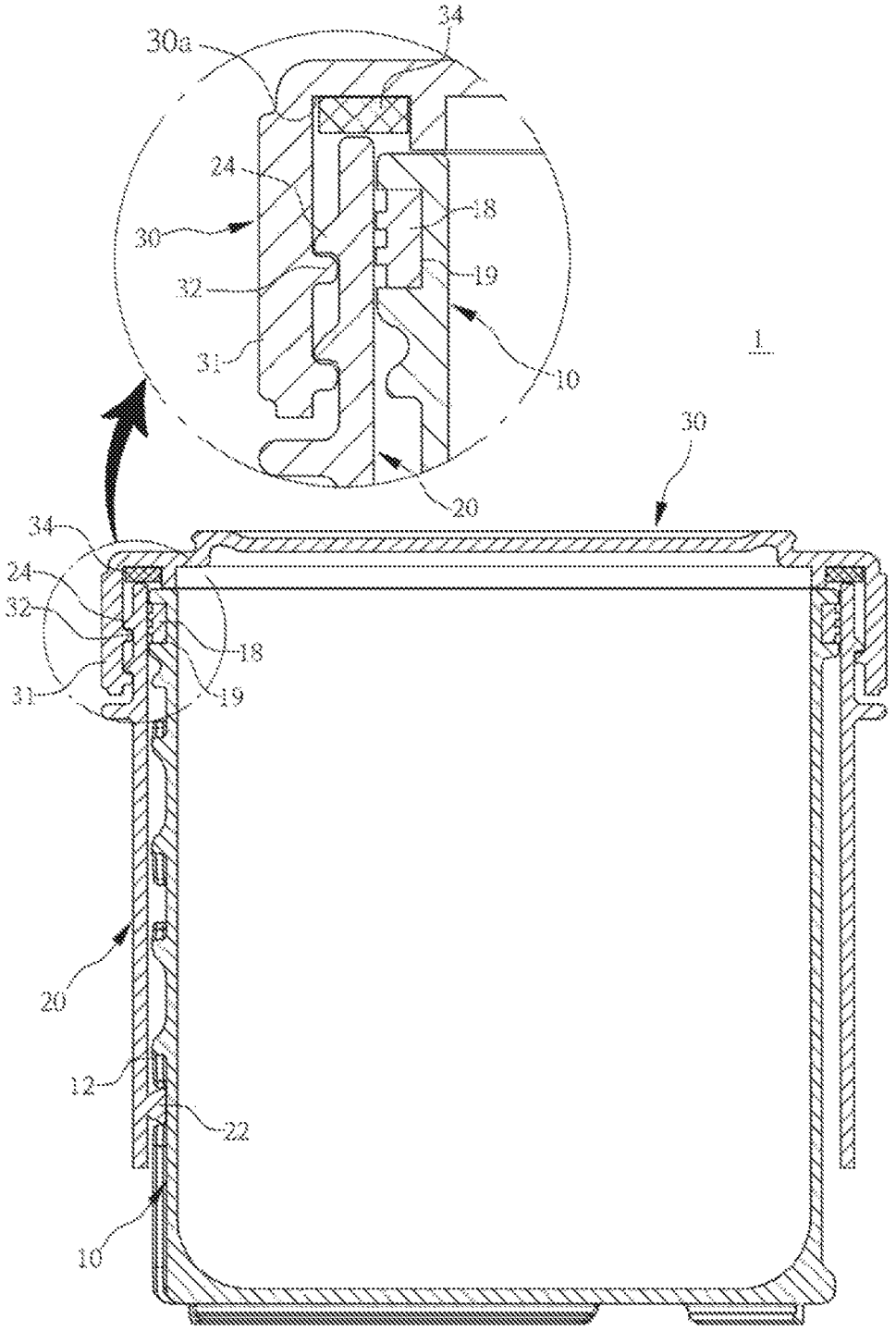
FIG. 3 is a combined sectional view showing the height-adjustable container according to the first embodiment of the present invention.

Referring to FIGS. 1 to 3, a height-adjustable container 1 according to a first embodiment of the present invention is configured such that a height the container that is used to store various foods, food ingredients, or the like can be selectively adjusted according to usage. Herein, a height is defined as an entire length measured when a first body 10 as a lower body is inserted into a second body 20 as an upper body. The container 1 includes: a first body 10 as a lower body including a height adjustment part 12 that is provided with a plurality of guide grooves 14 and a plurality of locking grooves 16, the guide grooves symmetrically and inclinedly arranged on an outside of the first body relative a vertical direction, the locking grooves circumferentially extending outward from corners of the guide grooves 14 and being alternately arranged on opposite sides of the guide grooves; and a second body 20 as an upper body coupled to the outside of the first body 10, and provided with a guide protrusion 22 guided along the guide grooves 14, wherein the guide protrusion 22 of the second body 20 is selectively locked to one of the locking grooves 16, whereby an entire height of the container is adjusted.

In other words, the present invention is configured such that the guide protrusion 22 of the second body 20 is guided along a plurality of guide grooves 14 symmetrically and inclinedly arranged on an outside of the first body relative a vertical direction by being moved from side to side while coming into close contact with the guide grooves, and is locked to one of the plurality of locking grooves 16 circumferentially extending outward from corners of the guide grooves 14 and being alternately arranged on opposite sides of the guide grooves, whereby the first body 10 and the second body 20 are coupled to each other such that a height of the container can be adjusted.

As described above, the height-adjustable container 1 according to the first embodiment of the present invention is configured such that when a height thereof is adjusted, the first body 10 and the second body 20 are divided into two to be gradually rotated from side to side in a zigzag form, whereby the height thereof can be easily adjusted, and further, since the height of the container 1 is gradually adjusted by being repetitively rotated from side to side in a zigzag form while coming into close contact with each other, it is possible to reduce an effect of vertical pressing force inside the container 1, whereby the height of the container 1 is not lowered unexpectedly by an abrupt external pressure.

Further, when the height of the container 1 is adjusted by applying vertical pressure to the first body 10 or the second body 20, the guide protrusion 22 is moved along the inclined guide grooves 14, whereby frictional force is generated between the guide protrusion 22 and the guide grooves 14, and a part of the vertical pressure is offset by the frictional force, so the height of the container 1 is not changed undesirably.

The first body 10, which is the lower body of the container and is in a cylindrical shape, is open at an upper portion thereof, and is formed with a bottom surface 10*a* at a lower portion thereof, wherein at least one height adjustment part 12 is formed in an outer circumferential surface of the first body. For example, as shown in the accompanying drawings, it is preferred that three height adjustment parts 12 are formed to face each other at angles of 120 degrees in a circumferential direction. Herein, in the example shown in the accompanying drawings, it is shown that three height adjustment parts 12 are formed at angles of 120 degrees in the circumferential direction. However, two or four height adjustment parts may be formed to face each other in the circumferential direction, but the number of height adjustment part is not limited thereto.

The height adjustment part 12 includes: the guide grooves 14 symmetrically and inclinedly arranged on the outside of the first body 10 relative the vertical direction; and the locking grooves 16 integrally and circumferentially extending outward from corners of the guide grooves 14 and being alternately arranged on opposite sides of the guide grooves. Neighboring guide grooves 14 and locking grooves 16 may be connected to each other at obtuse angles, for example, at an angle of 120 degrees, and a plurality of guide grooves 14 and the locking grooves 16 may be arranged up and down repeatedly in a lying Y shape to be a zigzag form. Herein, a connection angle between the guide groove 14 and the locking groove 16 is not limited to a predetermined angle. Further, the height adjustment part 12 may be formed in a raised shape, but may be formed in a depressed shape in some cases.

Of a plurality of guide grooves 14, the lowermost guide groove 14 communicates with a vertical guide groove 15 to extend to the bottom surface 10*a* of the first body 10. Accordingly, when the first body 10 is inserted into the second body 20, the guide protrusion 22 is engaged with an end of the vertical guide groove 15.

It is preferred that both the guide groove 14 and the locking groove 16 have a width of 5 mm, but the width thereof is not limited thereto.

The second body 20, which is the upper body of the container and is in a cylindrical shape with upper and lower portions thereof being open, is configured such that an inner diameter thereof is larger than an outer diameter of the first body 10, and when the first body 10 and the second body 20 are coupled to each other, the first body 10 and the second body 20 are maintained in a close contact state by the guide grooves 14 and the locking grooves 16 formed in a raised shape.

An inner circumferential surface of the second body 20 is protrudingly formed with three pairs of guide protrusions 22 at an angle of 120 degrees in a circumferential direction, the guide protrusions being moveable from side to side while coming into close contact with three pairs of height adjustment parts 12 of the first body 10.

Further, as shown in FIG. 2, each sectional shape of the guide groove 14, the vertical guide groove 15, and the locking grooves 16 is formed in a shape that has a width that is gradually narrow toward the second body 20; and a sectional shape of the guide protrusion 22 is formed in a shape that has a width that is gradually wide toward the first body 10, whereby after being coupled, the grooves and the protrusions are prevented from being separated from each other by a wedge shape.

Further, the locking groove 16 may be protrudingly formed with a stopper (not shown) to restrain movement of the guide protrusion 22 when the guide protrusion 22 is guided from the guide groove 14 to the locking groove 16. The stopper is formed by protruding from a location spaced from an end of the locking groove 16 away from the guide groove 14 toward the guide groove 14. Further, since the guide protrusion 22 is forced to be passed by the stopper when the guide protrusion 22 is guided from the guide groove 14 to the end of the locking groove 16, the guide protrusion 22 that is disposed at the end of the locking groove 16 is prevented from moving without external pressure.

Further, a rubber ring-shaped packing 18 is engaged with a packing groove 19 at an upper portion of the outer circumferential surface of the first body 10 so as to seal the first body and the second body 20. Herein, the packing groove 19 is disposed at a location higher than uppermost guide groove 14 and locking groove 16, but in some cases, the packing groove may be disposed at a lower portion of the outer circumferential surface of the first body 10. The rubber ring-shaped packing 18 serves to scrape contents remaining on an inner surface of the second body 20 when the height is adjusted, whereby it is possible to prevent contents remaining on an inner surface of the second body 20 from leaking outside, and since the rubber ring-shaped packing 18 comes into close contact between the first body 10 and the second body 20, it is possible to prevent the guide protrusion 22 of the second body 20 from being undesirably rotated from side to side or from being suddenly moved down or up from the guide grooves 14 and the locking grooves 16 of the height adjustment part 12. Further, the packing 18 may be mounted at the upper or the lower portion of the outer circumferential surface of the first body 10 without the packing groove 19.

Meanwhile, in the example shown in the accompanying drawings, the height adjustment part 12 is formed in the outer circumferential surface of the first body 10, but not limited thereto. In some cases, the height adjustment part 12 may be formed in an inner circumferential surface of the first body 10 to be in a raised shape or in a depressed shape. In this case, the second body 20 is configured such that an outer diameter thereof is smaller than an inner diameter of the first body 10 so as to be engaged with the inside of the first body 10, and the guide protrusion 22 may be formed in an outer circumferential surface of the second body 20. Here, the packing groove 19 is located at the lower portion of the outer circumferential surface of the second body 20, so the packing 18 may be provided at the lower portion of the outer circumferential surface of the second body 20. Further, the packing groove 19 may be located at the upper portion of the outer circumferential surface of the second body 20, and the packing 18 may be mounted at the upper or the lower portion of the outer circumferential surface of the second body 20 without the packing groove 19.

Further, a container lid 30 for sealing the inside of the container may be connected to the upper portion of the second body 20. To be more specific, the upper portion of the outer circumferential surface of the second body 20 may be formed with threads 24 to be engaged with the container lid 30, and the container lid 30 may be integrally provided with a coupling part 31 with threads 32 formed along an inner circumferential edge of a disk shaped body, so as to correspond to the threads 24 of the second body 20. However, the present invention is not limited to the above mentioned coupling structure, and the container lid 30 and the second body 20 may be coupled to each other by various coupling structures, such as an elastic protrusion.

The inner circumferential edge of the container lid 30 is formed with a seat groove 30*a* to receive the lid packing 34 therein. Accordingly, the present invention has excellent performance as vacuum sealed container since the container lid 30 and the second body 20 are sealed by the lid packing 34, and a gap between the second body 20 and the first body 10 is sealed by the packing 18, whereby it is possible to generate a vacuum by sealing the inside of the container while the height thereof is adjusted.

Meanwhile, the first body 10 and the second body 20 may be made of polymer resin or glass material harmless to the human body. As an example, polymer resin may be one of polyethylene terephthalate (PET), polycarbonate (PC), and silicon. Further, the first body 10 and the second body 20 may be made of heat-resistant material that can be used in a microwave oven, or the like, or may be made of transparent or translucent material that is made of heat-resistant glass, such that contents can be identified from the outside.

Figure 4:
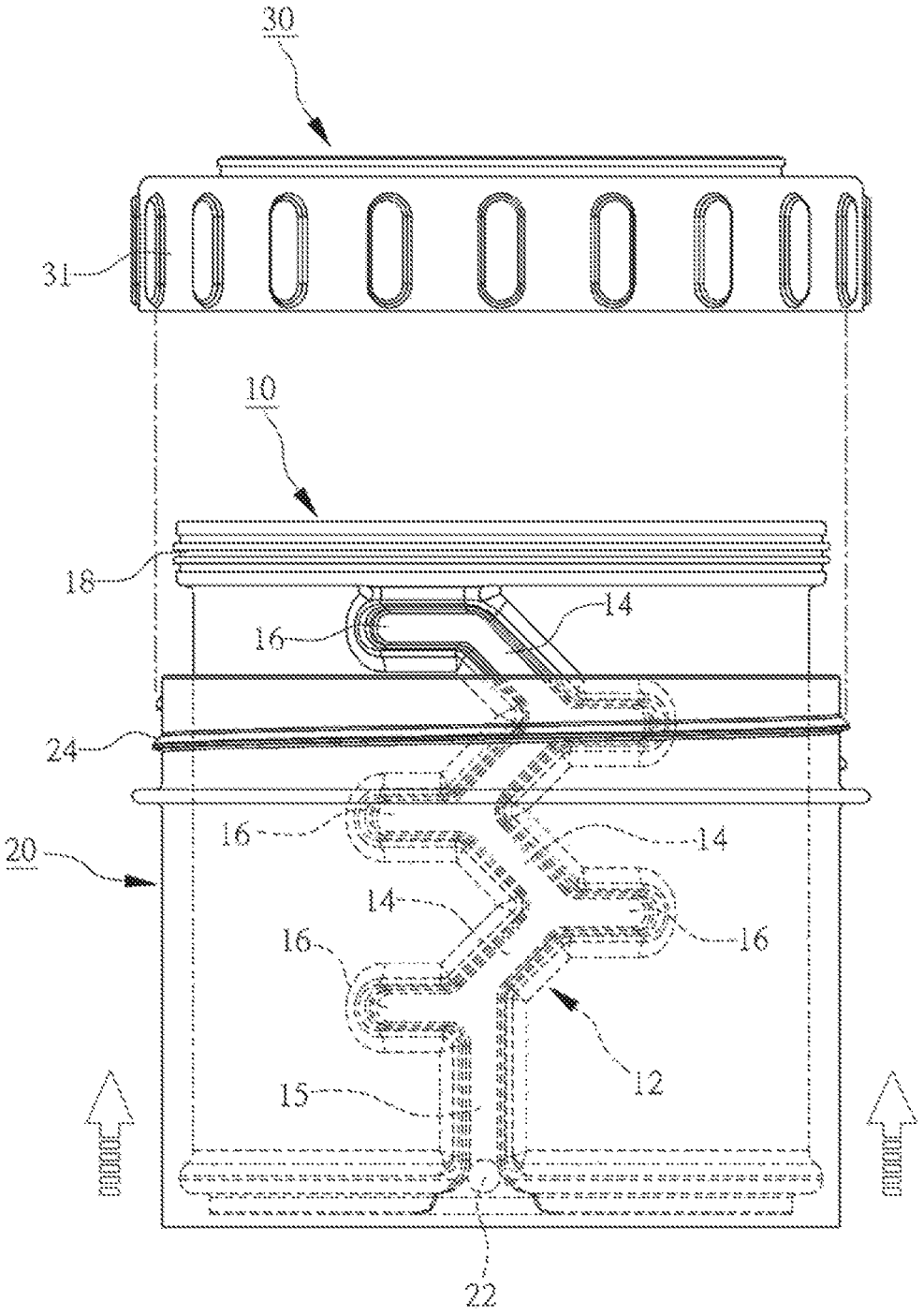
FIGS. 4 to 6 are views showing operation states of the height-adjustable container according to the first embodiment of the present invention.
Figure 5:
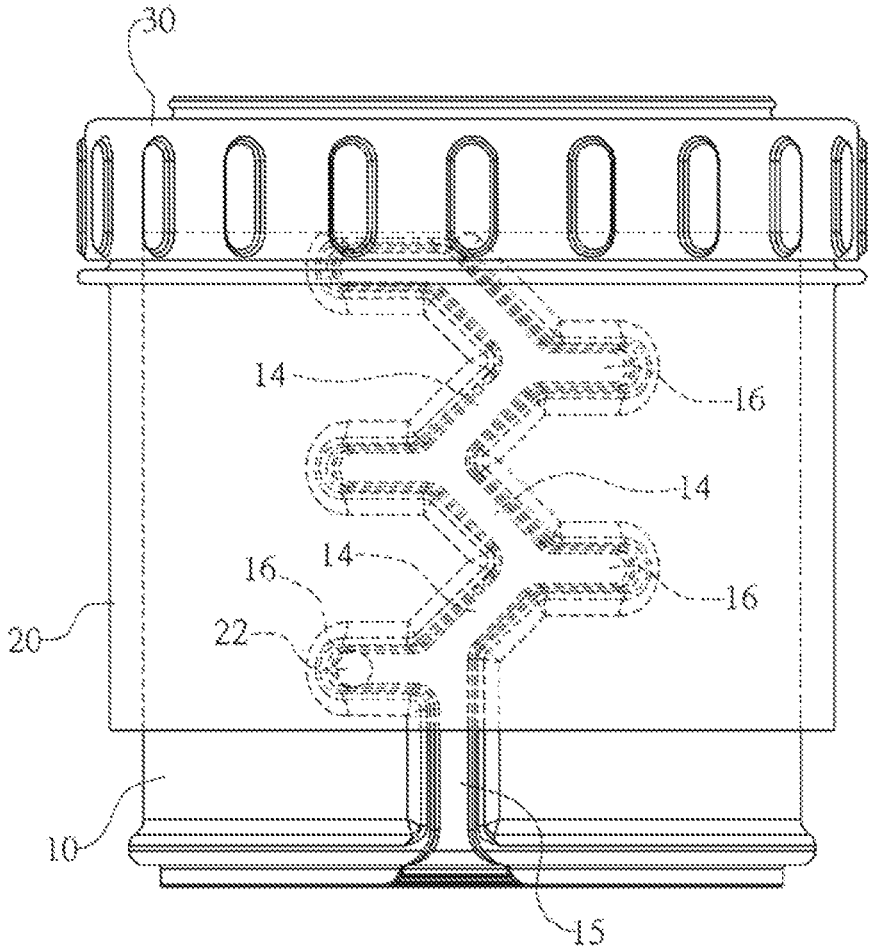
Figure 6:
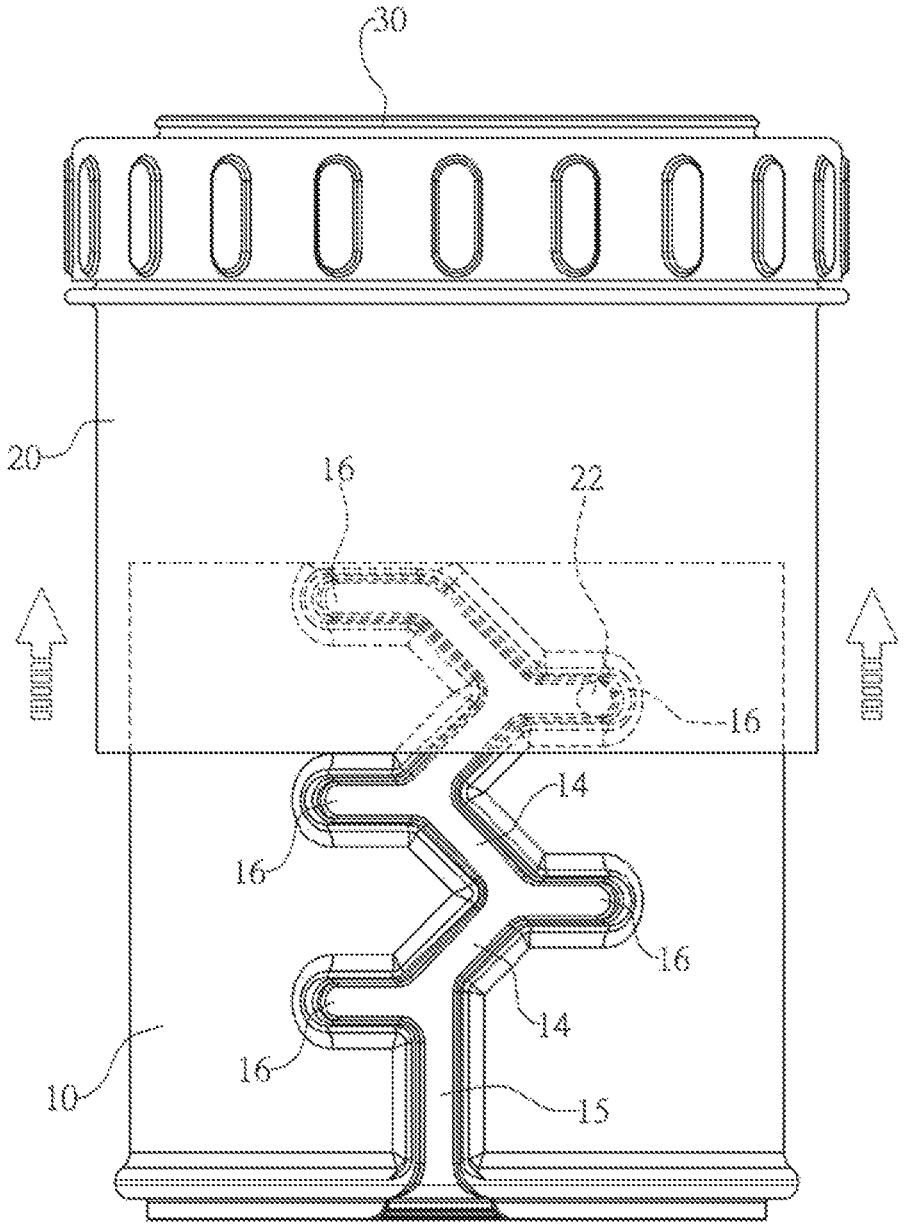

FIGS. 4 to 6 are views showing operation states of the height-adjustable container according to the first embodiment of the present invention.

Firstly, as shown in FIG. 4, the guide protrusion 22 of the second body 20 as the upper body of the container is inserted through a lower end of the vertical guide groove 15 of the first body 10 as the lower body of the container, such that the first body 10 and the second body 20 are coupled to each other.

Next, as shown in FIG. 5, the guide protrusion 22 of the second body 20 is slightly moved up along the vertical guide groove 15, and then is disposed at a lowermost locking groove of a plurality of guide grooves 14 and the locking grooves 16, such that a volume (the height) of the container is minimized. In other words, it is possible to efficiently keep the container in a sink or a cabinet.

Next, as shown in FIG. 6, when a large amount of food or food ingredients are stored in the height-adjustable container 1 according to the first embodiment of the present invention, the guide protrusion 22 of the second body 20 is continuously moved up along the guide grooves 14 and the locking grooves 16 by rotating the second body 20 (or the first body 10) from side to side clockwise and counterclockwise alternately while coming into close contact with each other, such that the guide protrusion 22 is disposed in an uppermost locking groove 16 of the height adjustment part 12 of the first body 10, whereby the volume of the container is maximized.

Of course, when the amount of food, food ingredients, or the like stored in the container 1 is reduced by being consumed, the guide protrusion 22 of the second body 20 is gradually moved down along the guide grooves 14 and the locking grooves 16 by being rotated from side to side while coming into close contact with each other, whereby it is possible to gradually reduce the height of the container.

As described above, since the present invention is configured such that the first body 10 and the second body 20 are rotated from side to side to adjust the height of the container 1, in the case where, for example, downward pressure is abruptly exerted onto the second body 20, the second body 20 should be moved down by being rotated from side to side clockwise and counterclockwise alternately along the inclined guide grooves 14 of the first body 10, whereby the height of the container 1 cannot be changed suddenly, and the height of the container 1 cannot be changed undesirably.

Further, when the height of the container 1 is adjusted by exerting vertical pressure onto the first body 10 or the second body 20, the guide protrusion 22 is moved along the guide grooves 14, whereby frictional force is generated between the guide protrusion 22 and the guide grooves 14, and a part of the vertical pressure is offset by the frictional force, so the height of the container 1 is not changed undesirably.

Figure 7:
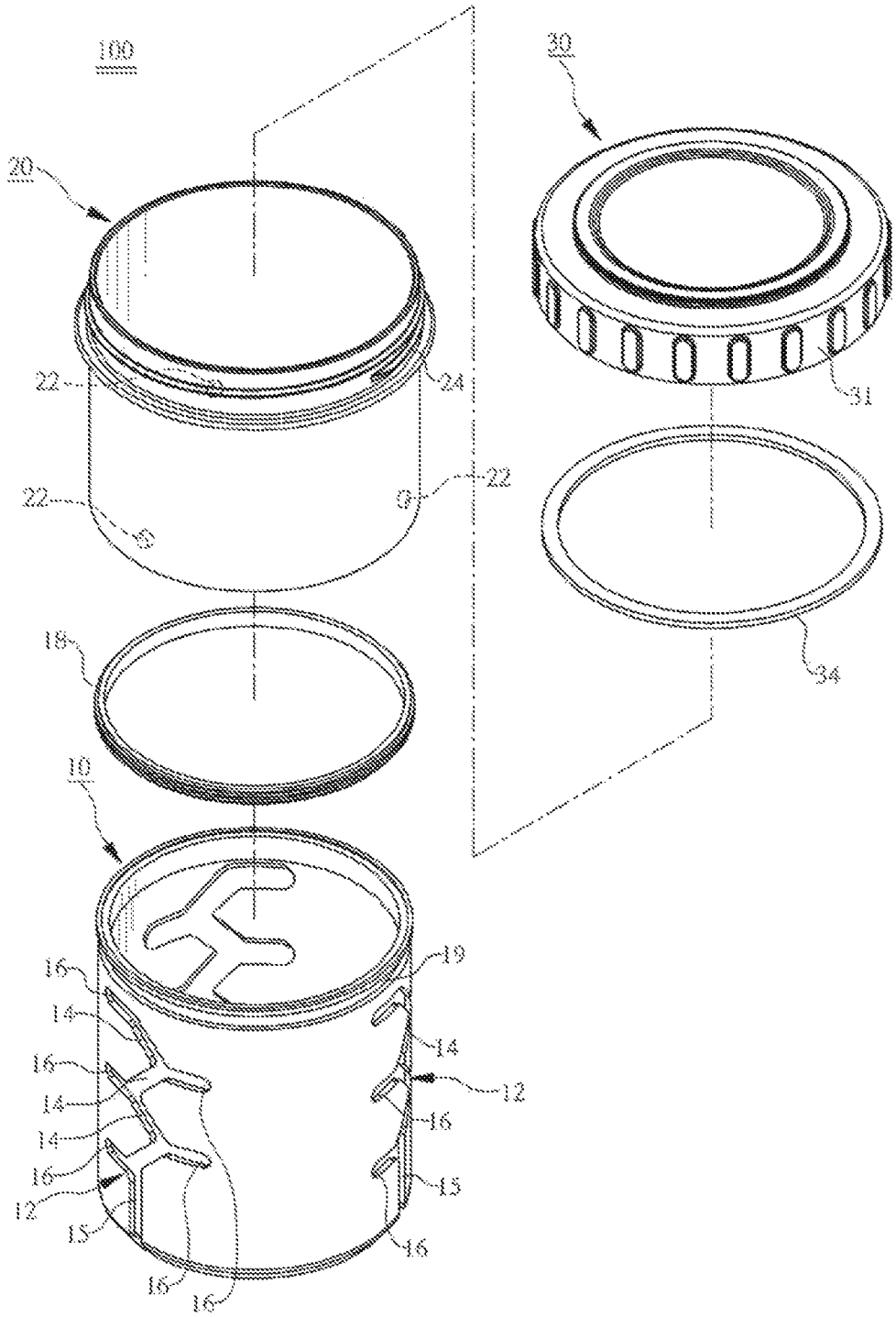
FIG. 7 is an exploded perspective view showing a height-adjustable container according to a second embodiment of the present invention.

FIG. 7 is an exploded perspective view showing a height-adjustable container according to a second embodiment of the present invention.

As shown in FIG. 7, a height-adjustable container 100 according to a second embodiment of the present invention is configured substantially the same as the height-adjustable container 1 shown in FIG. 1 according to the first embodiment of the present invention, except that the first body 10 is formed with the height adjustment part 12 in a depressed shape, wherein the height adjustment part is provided with a plurality of guide grooves 14 and a plurality of locking grooves 16, the guide grooves symmetrically and inclinedly arranged on the outside of the first body relative the vertical direction, the locking grooves circumferentially extending outward from corners of the guide grooves 14 and being alternately arranged on opposite sides of the guide grooves.

As described above, since the height adjustment part 12 of the first body 10 is formed in a depressed shape, adhesion between the first body 10 and the second body 20 is improved, whereby it is possible to have excellent performance as a vacuum sealed container.

Meanwhile, in the example shown in the accompanying drawings, the height adjustment part 12, which is formed in a zigzag form and includes the guide grooves 14, the vertical guide grooves 15, and the locking grooves 16, is formed in the outside of the first body 10 to be in a depressed shape, but the height adjustment part may be formed in an inside of the first body 10 to be in a depressed shape.

Figure 8:
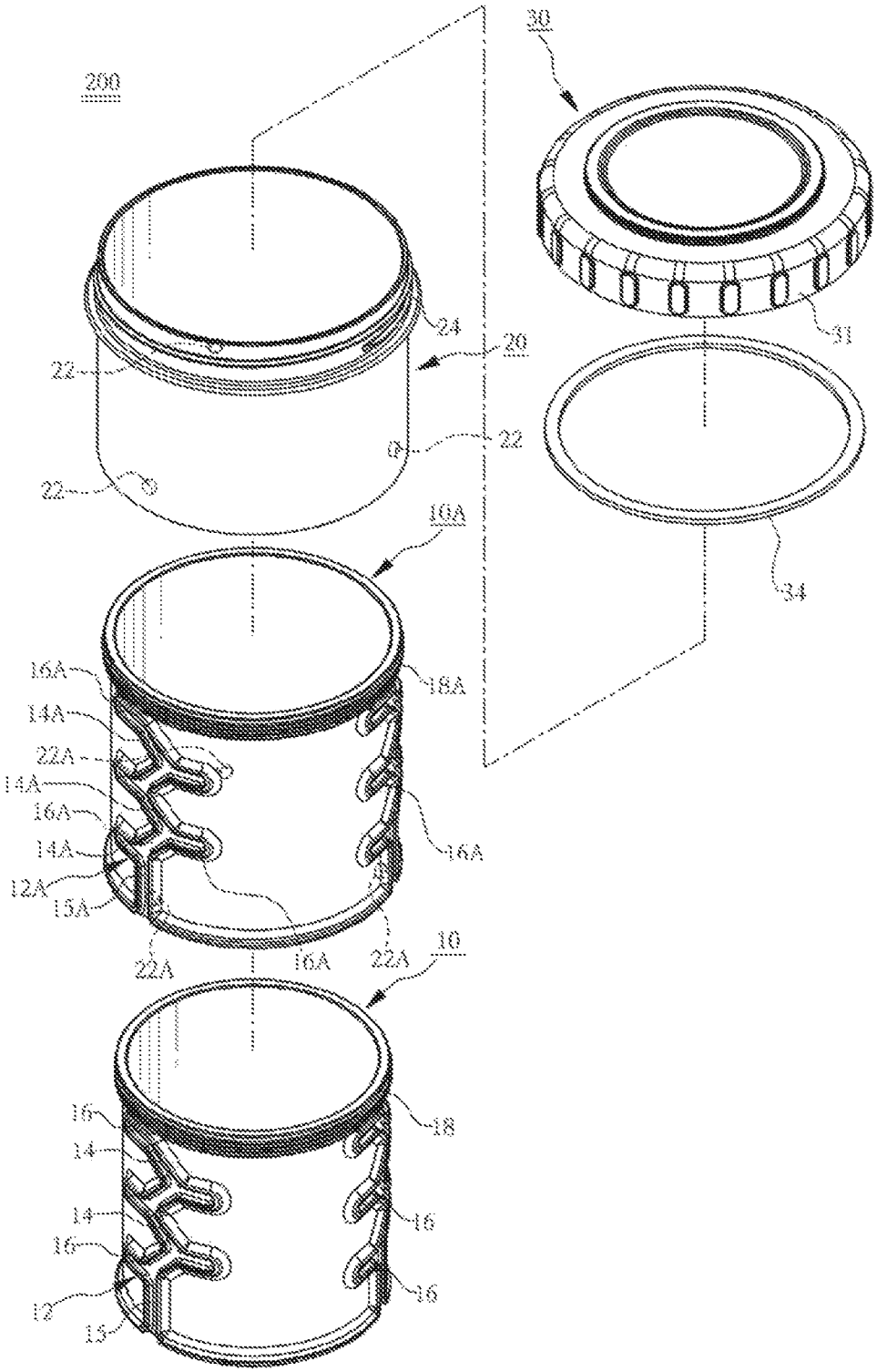
FIG. 8 is an exploded perspective view showing a height-adjustable container according to a third embodiment of the present invention.
Figure 9:
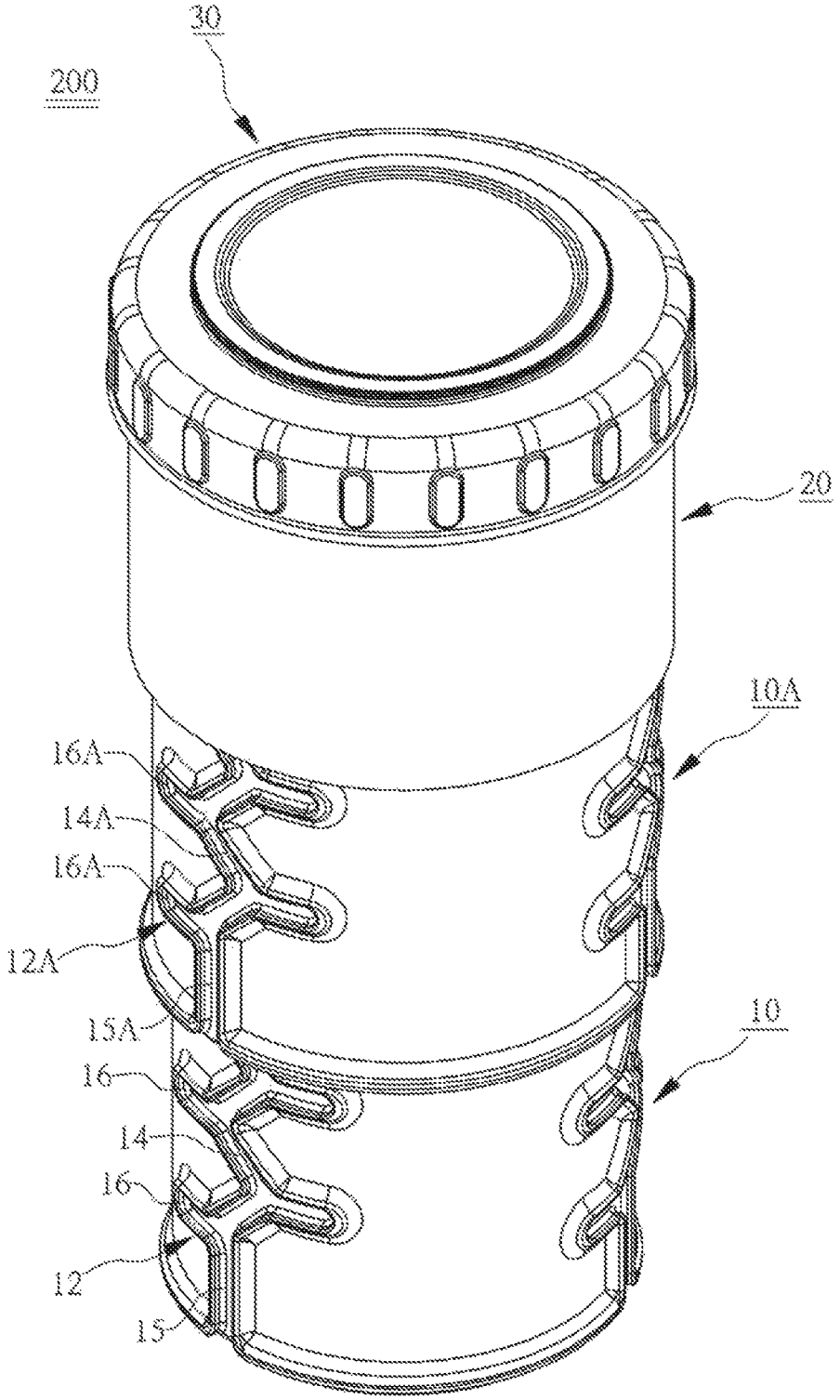
FIG. 9 is a combined perspective view showing the height-adjustable container according to the third embodiment of the present invention.

FIG. 8 is an exploded perspective view showing a height-adjustable container according to a third embodiment of the present invention; FIG. 9 is a combined perspective view showing the height-adjustable container according to the third embodiment of the present invention; and FIG. 10 is a combined sectional view showing the height-adjustable container according to the third embodiment of the present invention.

Figure 10:
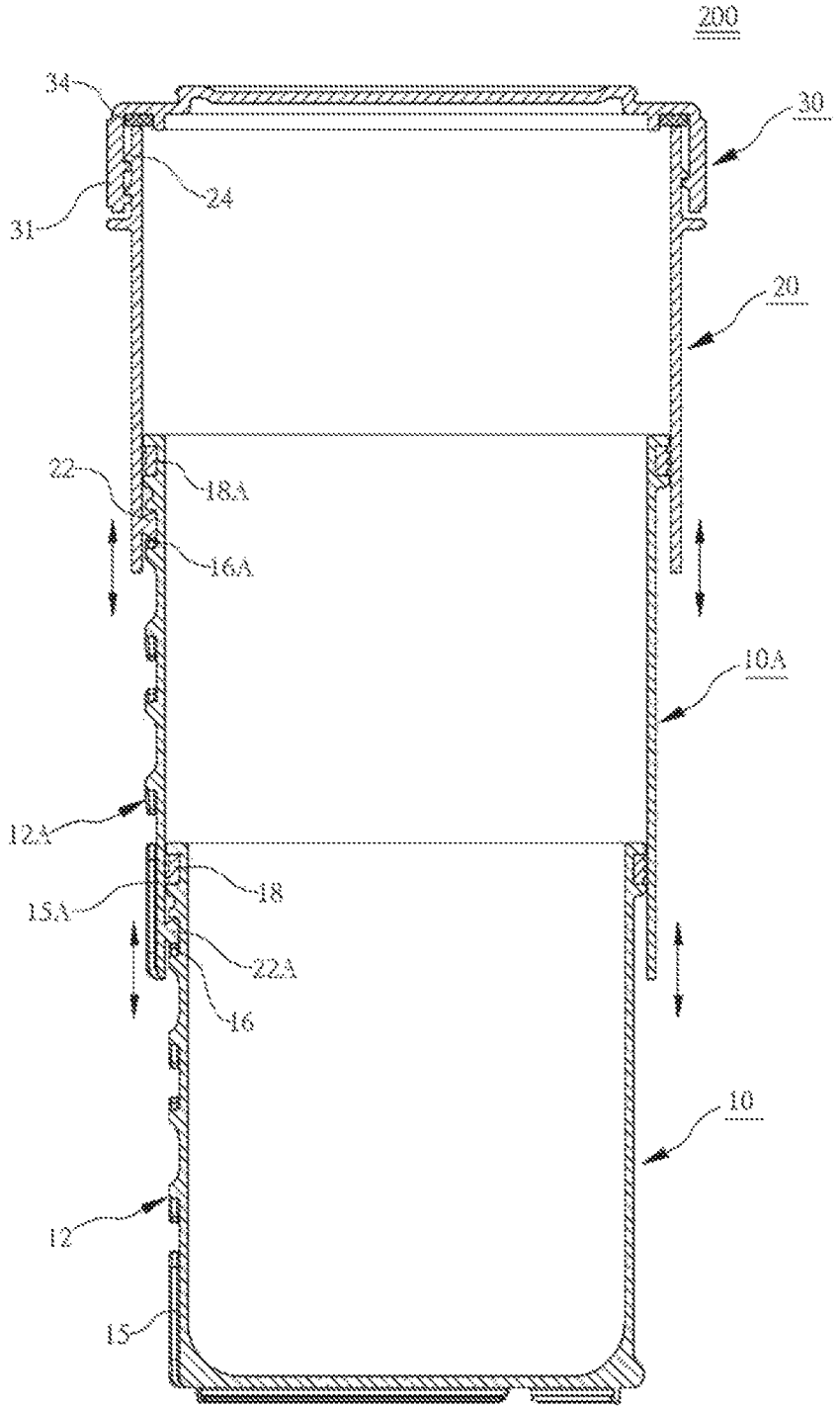
FIG. 10 is a combined sectional view showing the height-adjustable container according to the third embodiment of the present invention.

As shown in FIGS. 8 to 10, a height-adjustable container 200 according to a third embodiment of the present invention is configured substantially the same as the height-adjustable container 1 shown in FIG. 1 according to the first embodiment of the present invention, except that a middle body 10A is disposed between the first body 10, as the lower body, and the second body 20, as the upper body, to be formed in a three-layer body in a vertical direction, whereby it is possible to make the entire height of the container taller.

Of course, in the example shown in the accompanying drawings, bodies 10, 10A, and 20 that form the three-layer body are shown, but without being limited thereto, more than four layers may be possible.

As shown in the accompanying drawings, the first body 10 as the lower body includes the height adjustment part 12 that is provided with a plurality of guide grooves 14 symmetrically arranged on an outside thereof along a vertical direction to be inclined, and is provided with a plurality of locking grooves 16 horizontally extending from each of the guide grooves 14 and alternately arranged vertically, which is substantially the same as the first body 10 of the height-adjustable container 1 shown in FIG. 1. Of course, of a plurality of guide grooves 14, a lowermost guide groove communicates with the vertical guide groove 15.

The middle body 10A includes: at least one middle protrusion 22A protrudingly provided on an inner circumferential surface of a lower portion thereof in a circumferential direction; and at least one middle adjustment part 12A including a plurality of guide grooves 14A and a plurality of locking grooves 16A, wherein the guide grooves are symmetrically and inclinedly arranged on an outside of the middle adjustment part relative to a vertical direction, and the locking grooves circumferentially extend outward from corners of the guide grooves 14A and are alternately arranged on opposite sides of the guide grooves. Further, of a plurality of guide grooves 14A, a lowermost guide groove communicates with a vertical guide groove 15A.

Further, the second body 20 as the upper body is protrudingly provided on an inner circumferential surface of a lower end thereof in a circumferential direction with a guide protrusion 22 movable from side to side in the middle adjustment part 12A of the middle body 10A.

Accordingly, the middle protrusion 22A provided on the inner circumferential surface of the lower portion of the middle body 10A is capable of being moved from side to side in the height adjustment part 12 provided on the outer circumferential surface of the first body 10 while coming into close contact with the height adjustment part, whereby a height between the first body 10 and the middle body 10A can be adjusted; and the guide protrusion 22 provided on the inner circumferential surface of the lower end of the second body 20 as the upper body is capable of being moved from side to side in the middle adjustment part 12A provided on the outer circumferential surface of the middle body 10A while coming into close contact with the middle adjustment part, whereby a height between the second body 20 and the middle body 10A can be adjusted, so a height of the three-layer body can be adjusted.

FIGS. 11A to 11E are exemplary views showing various sectional shapes of guide grooves, vertical guide grooves, and locking grooves of the height-adjustable container according to the third embodiment of the present invention.

Figure 11:
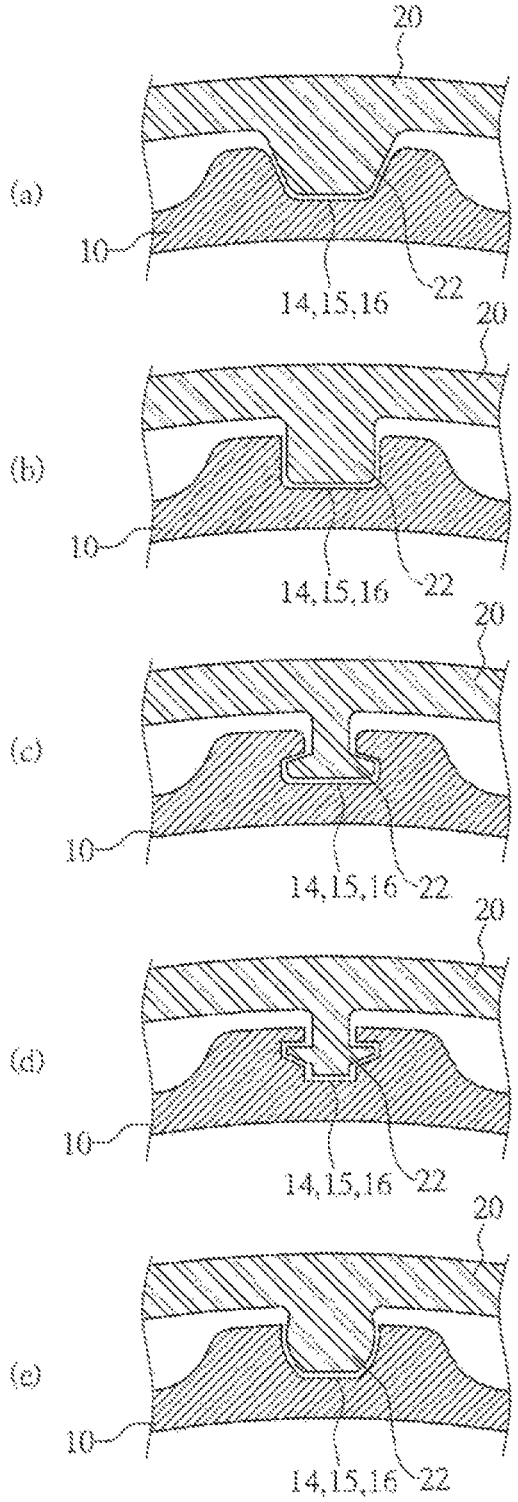
FIGS. 11A to 11E are exemplary views showing various sectional shapes of guide grooves, vertical guide grooves, and locking grooves of the height-adjustable container according to the third embodiment of the present invention.

Firstly, as shown in FIG. 11A, each sectional shape of the guide groove 14, the vertical guide groove 15, and the locking groove 16 is configured such that a width thereof is gradually wide as it approaches the second body. On the contrary, a sectional shape of the guide protrusion 22 of the second body 20, which is engaged with the above grooves, is configured such that a width thereof is gradually narrow as it approaches the first body 10.

Thereby, it is advantageous in that it is easy to clean the container after the first body 10 the second body 20 are separated from each other when compared to the example shown in FIG. 2 where each sectional shape of the guide groove 14, the vertical guide groove 15, and the locking groove 16 is configured such that a width thereof is gradually narrow as it approaches the second body 20, and on the contrary, a sectional shape of the guide protrusion 22 is configured such that a width thereof is gradually wide as it approaches the first body.

Further, as shown in FIG. 11B, each sectional shape of the guide protrusion 22, the guide groove 14, the vertical guide groove 15, and the locking groove 16 may be configured such that an upper portion and a lower portion thereof is the same, or as shown in FIGS. 11C and 11D, an end of the guide protrusion 22 may be formed with a wedge protrusion, and each end of the guide groove 14, the vertical guide groove 15, and the locking groove 16 may be formed with a wedge groove.

Of course, as shown in FIG. 11E, the guide protrusion 22 may be formed to be a cylindrical protrusion in a jar shape.

Consequently, each sectional shape of the guide protrusion 22, the guide groove 14, the vertical guide groove 15, and the locking groove 16 according to the present invention may be in various shapes, and may not be limited to a predetermined shape as long as a sectional shape of the guide protrusion 22 is in the form of a protrusion, and each sectional shape of the guide groove 14, the vertical guide groove 15, and the locking groove 16 is in the form of a groove, whereby after coupling, it is difficult for the protrusion to be separated from the corresponding groove.

Figure 12:
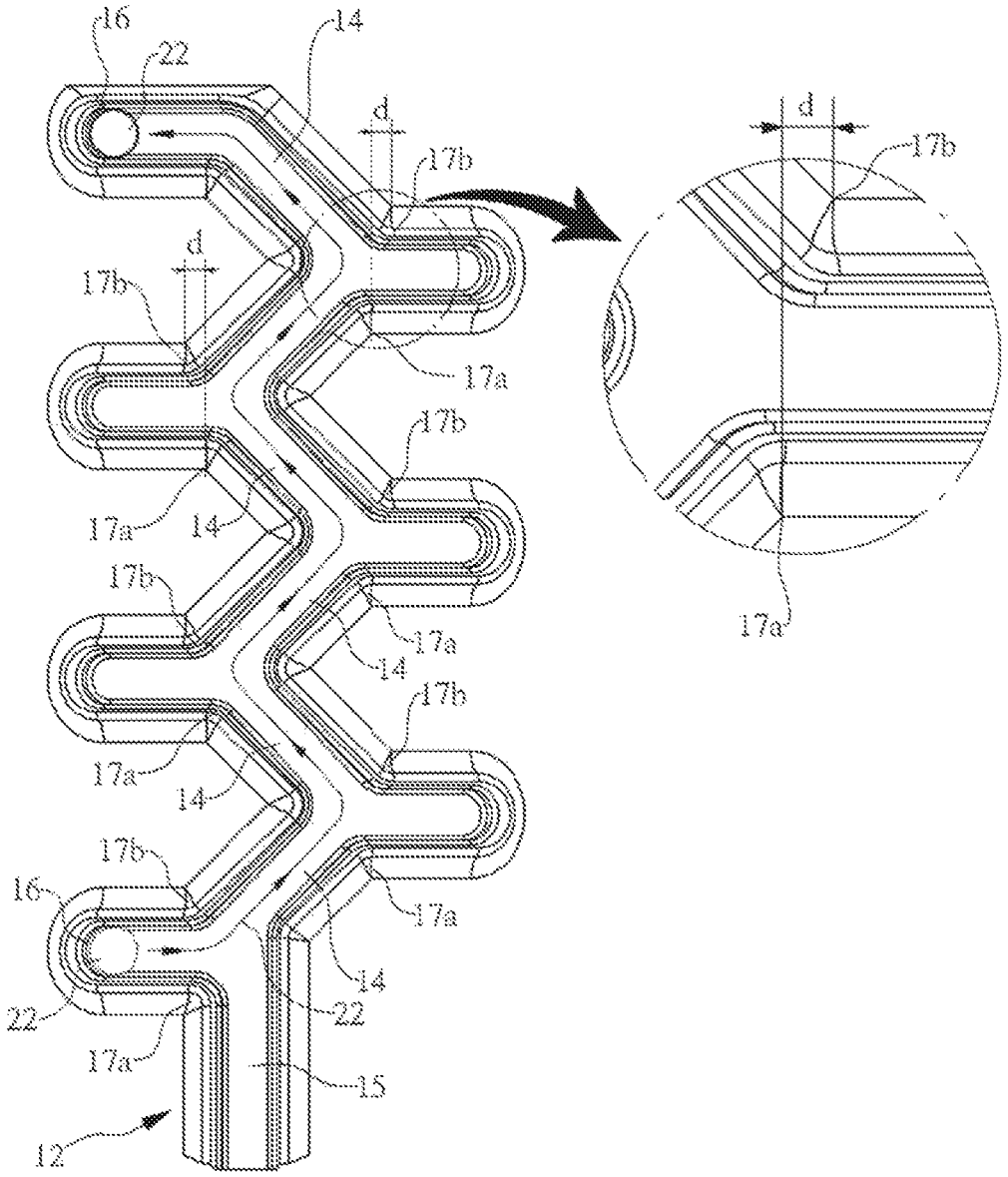
FIGS. 12 and 13 are schematic operational views showing move of guide protrusion by being upwardly moved from side to side and by being downwardly moved from side to side.
Figure 13:
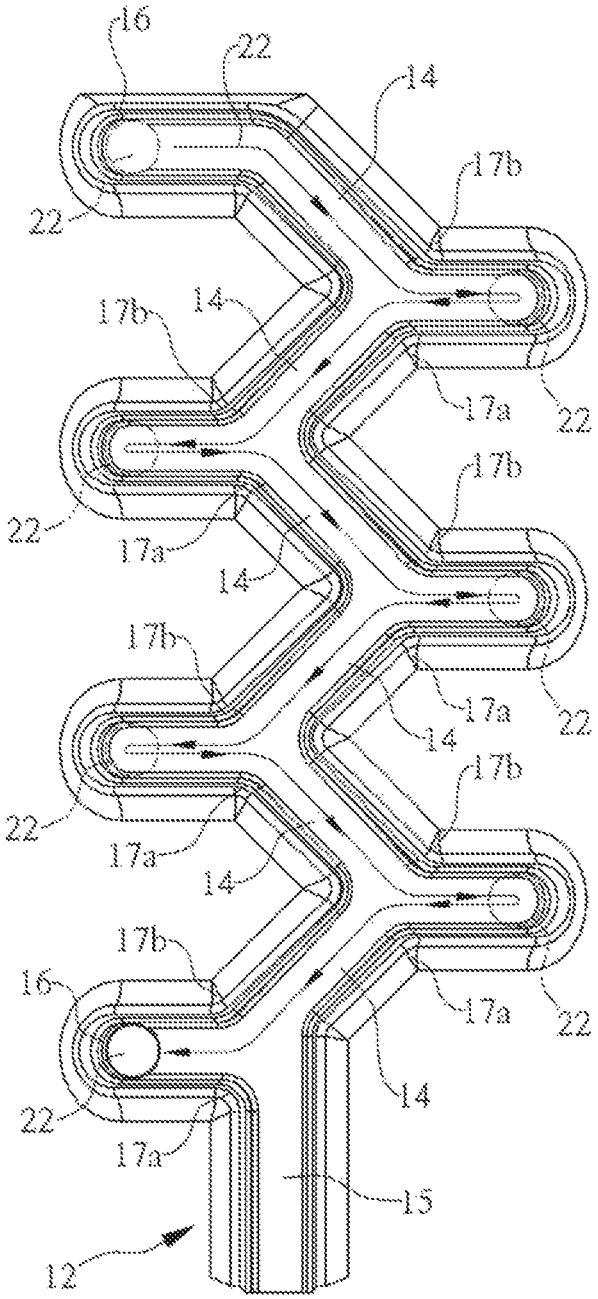

FIGS. 12 and 13 are schematic operational views showing move of guide protrusion by being upwardly moved from side to side and by being downwardly moved from side to side.

As shown in FIGS. 12 and 13, a lower connection part 17*a* connecting lower portions of neighboring guide groove 14 and locking groove 16 to each other, and an upper connection part 17*b* connecting upper portions of the neighboring guide groove 14 and locking groove 16 to each other are not arranged linearly based on a vertical direction, but the lower connection part 17*a* is disposed closer to the guide groove 14 than the upper connection part 17*b* is (see a width d in the drawings).

Accordingly, as shown in FIG. 12, in the case of rotation from side to side in an upward direction, since the lower connection part 17*a* is formed further inside than the upper connection part 17*b*, the guide protrusion 22 is easily moved along the guide grooves 14, whereby it is possible to promptly increase the height of the container.

On the contrary, as shown in FIG. 13, in the case of rotation from side to side in a downward direction, while the guide protrusion 22 is moved down along the inclined guide grooves 14, the guide protrusion is supported by a top surface of the lower connection part 17*a*, whereby it is inclined to be guided into a neighboring locking groove 16 rather than move straightly down, so moving downward is more difficult than moving upward based on FIG. 12, and accordingly, moving downward is restrained by the locking grooves 16 in a click-stop manner.

Of course, in the example shown in the accompanying drawings, the lower connection part 17*a* is formed further inside than the upper connection part 17*b*, but the upper connection part 17*b* may be formed further inside than the lower connection part 17*a*. In other words, the upper connection part 17*b* may be disposed closer to the guide groove 14 than the lower connection part 17*a* is, based on a vertical direction. In this case, contrary to FIGS. 12 and 13, moving downward is easier than moving upward.

Figure 14:
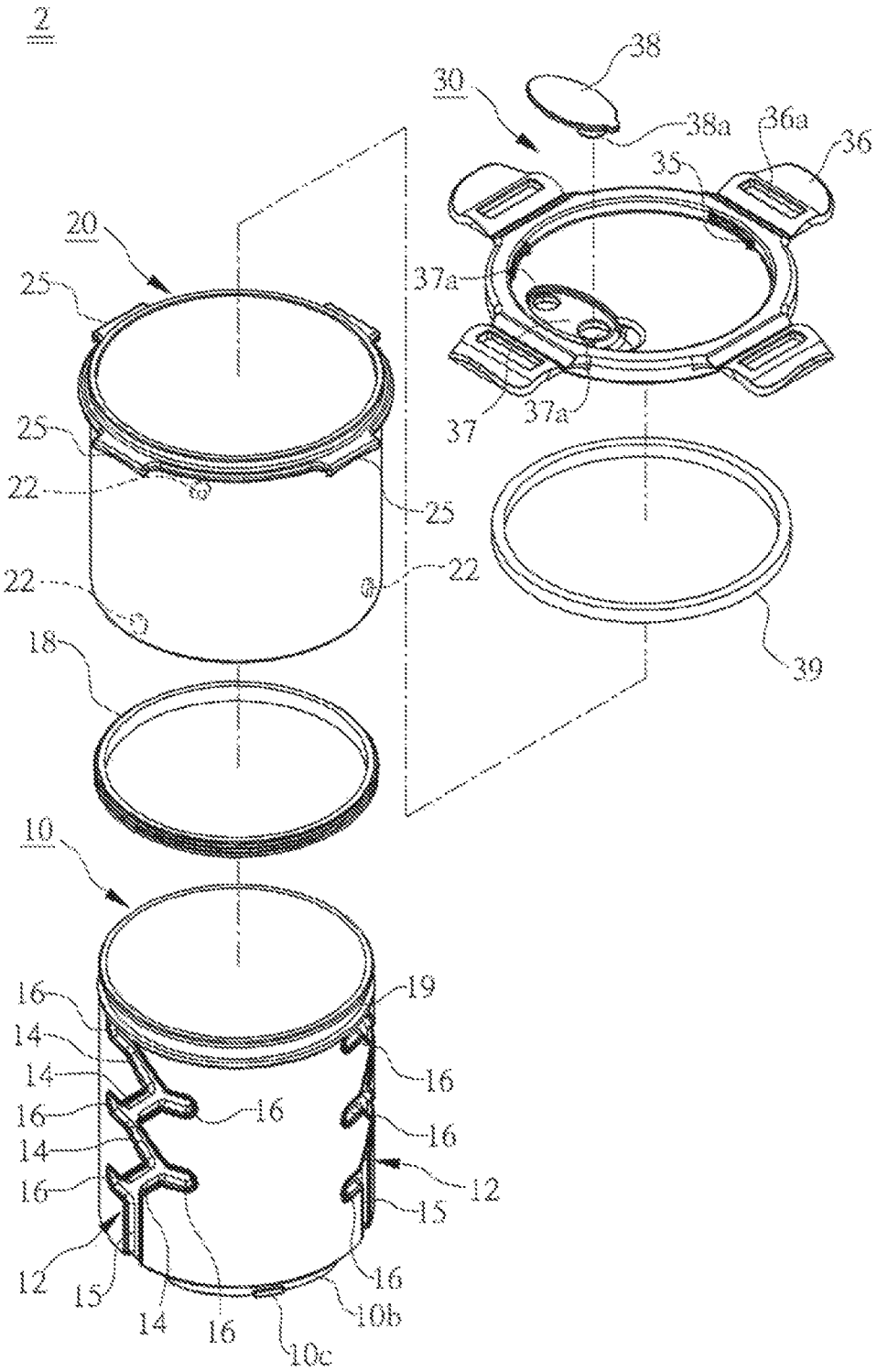
FIG. 14 is an exploded perspective view showing a height-adjustable container according to a fourth embodiment of the present invention.
Figure 15:
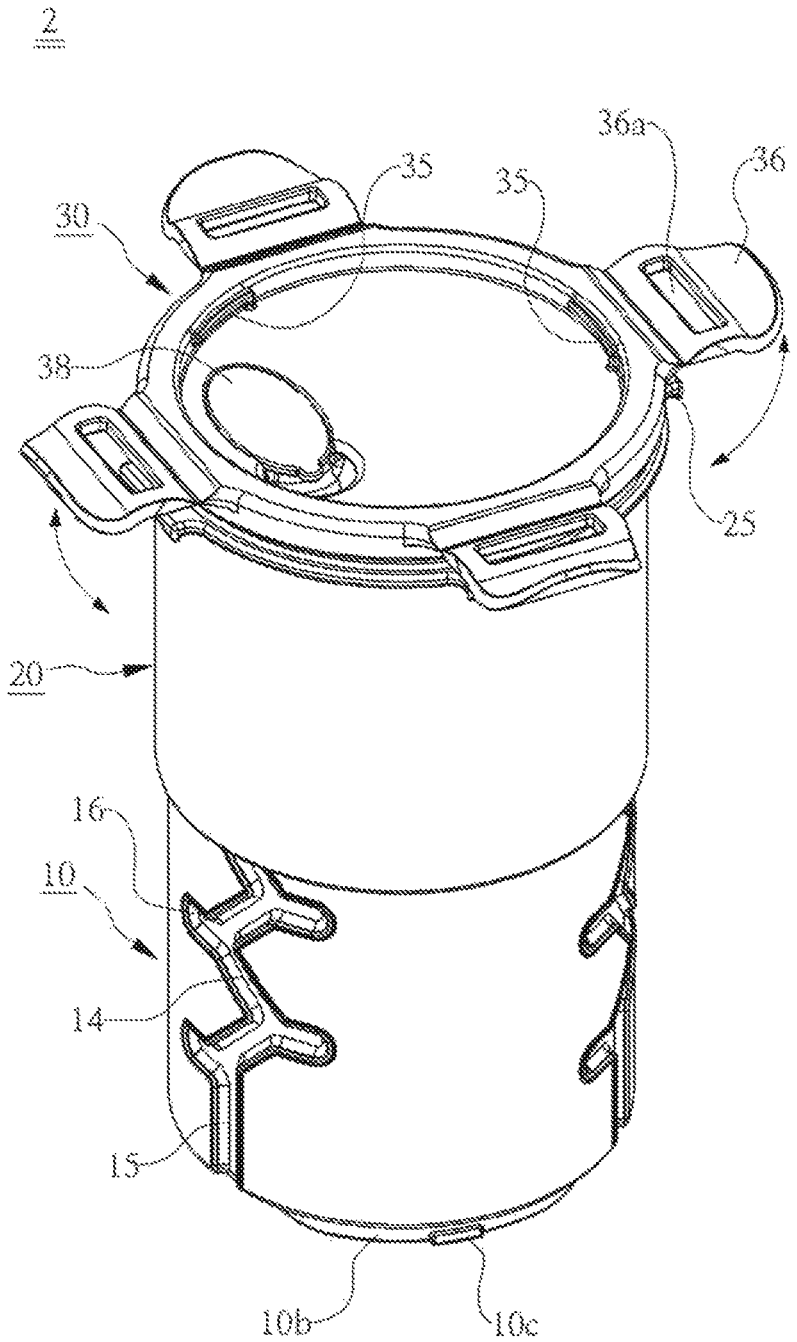
FIG. 15 is a combined perspective view showing the height-adjustable container according to the fourth embodiment of the present invention.
Figure 16:
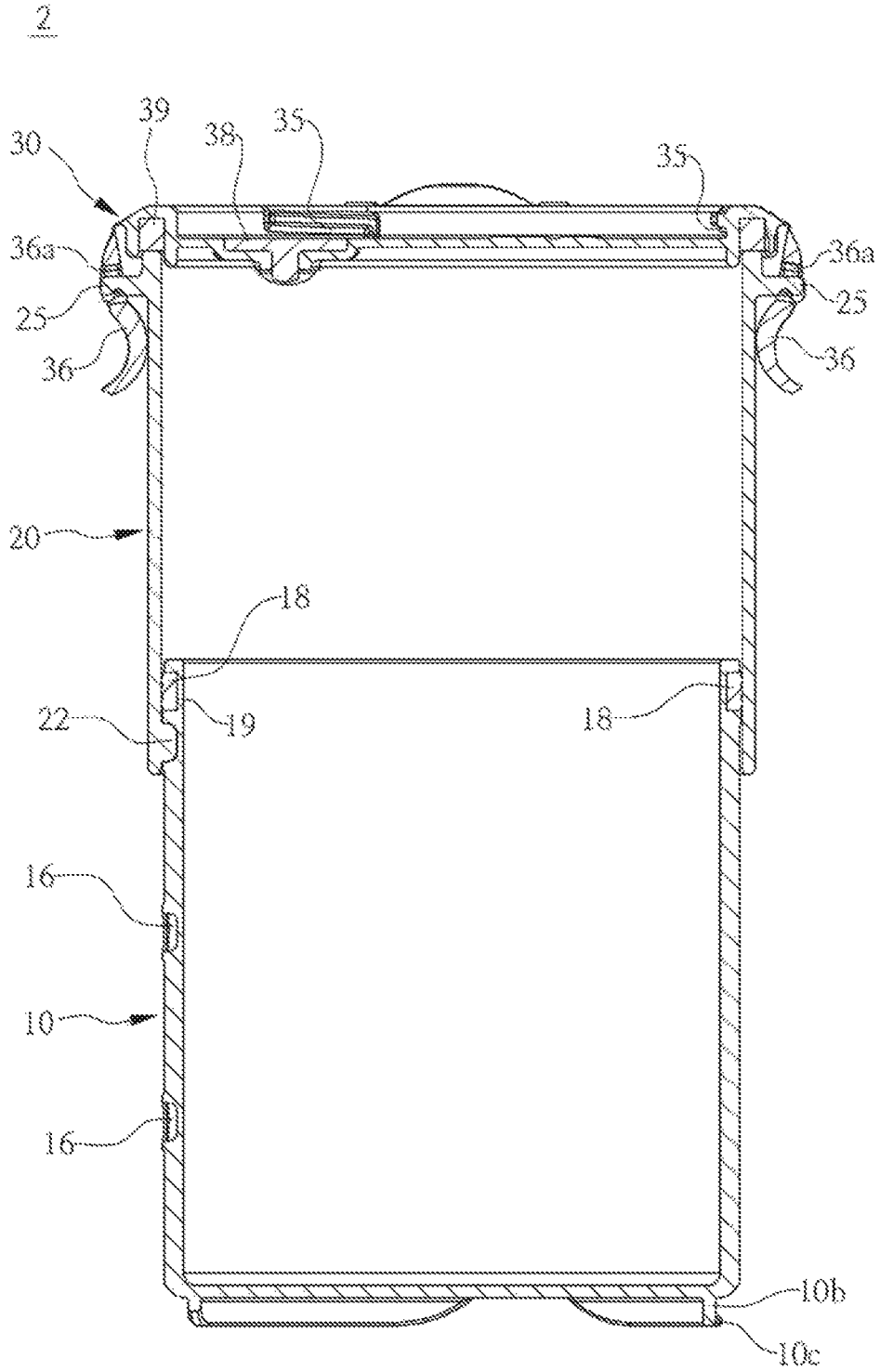
FIG. 16 is a combined sectional view showing the height-adjustable container according to the fourth embodiment of the present invention.

FIG. 14 is an exploded perspective view showing a height-adjustable container according to a fourth embodiment of the present invention; FIG. 15 is a combined perspective view showing the height-adjustable container according to the fourth embodiment of the present invention; and FIG. 16 is a combined sectional view showing the height-adjustable container according to the fourth embodiment of the present invention Referring to FIGS. 14 to 16, a height-adjustable container 2 according to a fourth embodiment of the present invention includes the first body 10 as the lower body, and the second body 20 as the upper body, wherein the container lid 30 coupled to the second body 20 is configured to be different from that in the first embodiment.

The container lid 30 is configured to cover an upper portion of the second body 20, and to be provided with a plurality of coupling guide parts 36 extending outside along an outer circumference of the container lid. The coupling guide parts 36 are configured to movable toward coupling protrusions 25, which will be described hereinafter. Further, a plurality of coupling protrusions 25 is provided along an outer circumferential edge of the upper end of the second body 20, and the coupling guide parts 36 of the container lid 30 are provided with respective coupling guide holes 36*a*, such that when the coupling guide parts 36 are moved toward the coupling protrusions 25, the coupling protrusions 25 are inserted into the respective coupling guide holes 36*a*. Further, when the coupling guide parts 36 are moved toward the coupling protrusions 25, the coupling protrusions 25 are inserted into and engaged with the respective coupling guide holes 36*a*. Further, a lid packing 39 is provided at an inner circumferential edge of the container lid 30, so as to seal a gap between the container lid 30 and the second body 20.

Further, a top surface of the container lid 30 may be further provided with an auxiliary lid 38 made of a water-tight material, such as rubber, or the like. To achieve this, the top surface of the container lid 30 is formed with a concave portion 37, and the concave portion 37 is formed with a through-hole 37*a*. Further, the auxiliary lid 38 is inserted into the concave portion 37, and here, the auxiliary lid 38 is protrudingly formed with a sealing protrusion 38*a* that is inserted into the through-hole 37*a*, thereby sealing the through-hole 37*a*. Further, in the state where the container lid 30 is not opened, the auxiliary lid 38 is opened, and the through-hole 37*a* is exposed outside, whereby contents in the inside the container 2 can be discharged outside through the through-hole 37*a*.

Further, when the height between the first body 10 and the second body 20 is adjusted, it is difficult to adjust the height because the inside of the container 2 is tightly sealed in the state where the container lid 30 is not opened. On the contrary, since the present invention is provided with the auxiliary lid 38 in the container lid 30, the container 30 is unsealed by opening the auxiliary lid 38 without opening the container lid 30, whereby it is possible to easily adjust the height of the container 2.

Further, an edge of the top surface of the container lid 30 may be provided with a first coupling part 35, and an edge of the bottom surface of the first body 10 may be provided with a second coupling part 10*b*, and a coupling protrusion 10*c*, which will be described with reference to FIG. 17, hereinbelow.

Figure 17:
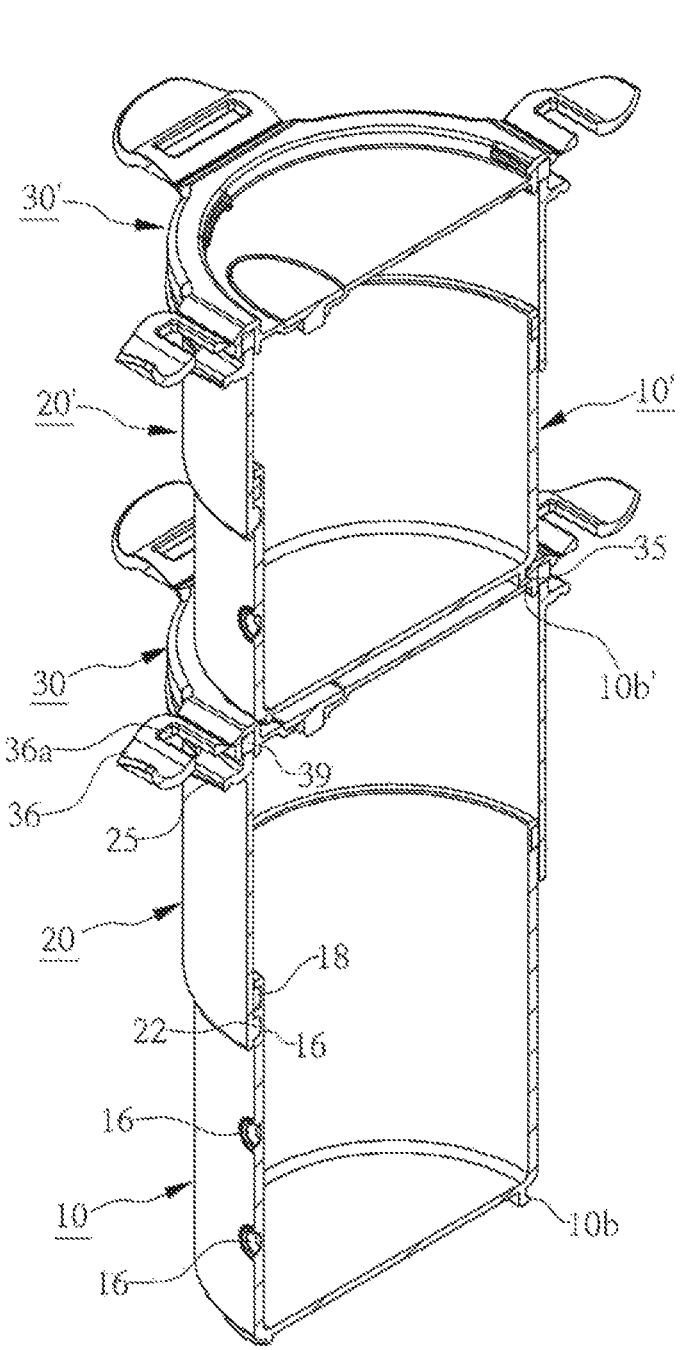
FIG. 17 is a view showing a state where a height-adjustable container according to a fifth embodiment of the present invention is coupled to be in multiple layers.

FIG. 17 is a view showing a state where a height-adjustable container according to a fifth embodiment of the present invention is coupled to be in multiple layers.

Referring to FIG. 17, a height-adjustable container 2' is configured such that a third body 10', a fourth body 20', and a sub-lid 30', which are coupled to each other, are coupled on top of the first body 10, the second body 20, and the container lid 30, which are coupled to each other, to be in multiple layers. Here, the first coupling part 35 of the container lid 30 may be engaged with the second coupling part 10*b'* of the third body 10'. Herein, shapes and functions of the third body 10', the fourth body 20', and the sub-lid 30' are the same as the first body 10, the second body 20, and the container lid 30, so detailed description thereof will be omitted. Meanwhile, lengths of the third body 10' and the fourth body 20' may vary, and they may be provided in plural, so the number thereof is not limited to a predetermined number in the present invention.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A height-adjustable container comprising:

a first body including a height adjustment part that is provided with a plurality of guide grooves and a plurality of locking grooves, the guide grooves symmetrically and inclinedly arranged on an outside or an inside of the first body relative a vertical direction, the locking grooves integrally and circumferentially extending outward from corners of the guide grooves and being alternately arranged on opposite sides of the guide grooves; and a second body coupled to the outside or the inside of the first body, and provided with a guide protrusion guided along the guide grooves, wherein when a height between the first body and the second body is adjusted, the guide protrusion of the second body is alternately moved from side to side along the plurality of locking grooves, wherein the guide grooves and the locking grooves are connected to each other at obtuse angles.

2. A height-adjustable container comprising:

a first body including a height adjustment part that is provided with a plurality of guide grooves and a plurality of locking grooves, the guide grooves symmetrically and inclinedly arranged on an outside or an inside of the first body relative a vertical direction, the locking grooves integrally and circumferentially extending outward from corners of the guide grooves and being alternately arranged on opposite sides of the guide grooves, wherein the guide grooves are arranged in a zigzag form, and are integrally connected to each other; and a second body coupled to the outside or the inside of the first body, and provided with a guide protrusion guided along the guide grooves, wherein when a height between the first body and the second body is adjusted, the guide protrusion of the second body is alternately moved from side to side along the plurality of locking grooves.

3. The height-adjustable container of claim 2, wherein a lowermost or an uppermost guide groove of the guide grooves communicates with a vertical guide groove and extends to a lower end or an upper end of the first body.

4. The height-adjustable container of claim 2, wherein the height adjustment part protrudes from the first body to be in a raised shape, or is grooved in the first body to be in a depressed shape.

5. The height-adjustable container of claim 2, further comprising:

a third body provided between the first body and the second body, wherein the third body is provided with a third protrusion having a same shape as the guide protrusion, at a first side thereof facing the height adjustment part of the first body when the first body and the third body are coupled to each other, such that the third protrusion is guided along the height adjustment part, and the third body is provided with a third adjustment part having a same shape as the height adjustment part, at a second side thereof facing the guide protrusion when the second body and the third body are coupled to each other, such that the guide protrusion is guided along the third adjustment part.

6. The height-adjustable container of claim 2, further comprising:

a packing for sealing a gap between the first body and the second body.

7. The height-adjustable container of claim 6, wherein when the second body is coupled to the outside of the first body, the packing is mounted to the outside of the first body.

8. The height-adjustable container of claim 6, wherein when the second body is coupled to the inside of the first body, the packing is mounted to an outside of the second body.

9. The height-adjustable container of claim 6, wherein the first body or the second body is provided with a packing groove that receives the packing therein.

10. The height-adjustable container of claim 9, wherein when the second body is coupled to the outside of the first body, the packing groove is provided in the outside of the first body, wherein the packing groove is disposed higher than an uppermost guide groove of the guide grooves and an uppermost locking groove of the locking grooves.

11. The height-adjustable container of claim 9, wherein when the second body is coupled to the inside of the first body, the packing groove is disposed at an outside of a lower end of the second body.

12. The height-adjustable container of claim 2, further comprising:

a container lid coupled to an end of the second body.

13. The height-adjustable container of claim 12, further comprising:

a plurality of coupling protrusions provided along an outer circumferential edge of the second body; and a plurality of coupling guide parts extending outside along an outer circumference of the container lid, and being movable toward the coupling protrusions, wherein the coupling guide parts are provided with respective coupling guide holes, such that when the coupling guide parts are moved toward the coupling protrusions, the coupling protrusions are inserted into the respective coupling guide holes.

14. The height-adjustable container of claim 12, further comprising:

a lid packing provided between the container lid and the second body; and a seat groove provided in an inner circumferential surface of the container lid so as to receive the lid packing therein.

15. The height-adjustable container of claim 12, further comprising:

a through-hole provided in a top surface of the container lid; and an auxiliary lid for opening and closing the through-hole.

16. The height-adjustable container of claim 2, further comprising:

a lower connection part connecting lower portions of neighboring guide groove and locking groove to each other; and an upper connection part connecting upper portions of the neighboring guide groove and locking groove to each other, wherein the lower connection part and the upper connection part are disposed to avoid facing each other.

17. The height-adjustable container of claim 16, wherein the lower connection part is disposed closer to the guide groove than the upper connection part is.

18. The height-adjustable container of claim 16, wherein the upper connection part is disposed closer to the guide groove than the lower connection part is.

19. A height-adjustable container comprising:

a first body including a height adjustment part that is provided with a plurality of guide grooves and a plurality of locking grooves, the guide grooves symmetrically and inclinedly arranged on an outside or an inside of the first body relative a vertical direction, the locking grooves integrally and circumferentially extending outward from corners of the guide grooves and being alternately arranged on opposite sides of the guide grooves; and a second body coupled to the outside or the inside of the first body, and provided with a guide protrusion guided along the guide grooves, wherein when a height between the first body and the second body is adjusted, the guide protrusion of the second body is alternately moved from side to side along the plurality of locking grooves, wherein the guide protrusion of the second body is guided by being moved from side to side along the guide grooves while coming into close contact with the guide grooves, and is locked in one of the plurality of locking grooves that are alternately arranged at respective corners of the guide grooves to be symmetrical to each other, whereby the height between the first body and the second body is adjusted.

* * * * *